US009796065B2

(12) United States Patent
Urban

(10) Patent No.: US 9,796,065 B2
(45) Date of Patent: Oct. 24, 2017

(54) PRECISION CLAMPING APPARATUS FOR SANDING ACOUSTIC GUITAR SADDLES

(71) Applicant: Kase Charles Urban, League City, TX (US)

(72) Inventor: Kase Charles Urban, League City, TX (US)

(73) Assignee: Kase C. Urban, League City, TX (US)

( * ) Notice: Subject to any disclaimer, the term of this patent is extended or adjusted under 35 U.S.C. 154(b) by 123 days.

(21) Appl. No.: 14/960,366

(22) Filed: Dec. 5, 2015

(65) Prior Publication Data

US 2017/0157737 A1 Jun. 8, 2017

(51) Int. Cl.

| | |
|---|---|
| ***B24B 41/06*** | (2012.01) |
| ***B25B 1/10*** | (2006.01) |
| ***B25B 9/04*** | (2006.01) |
| ***G10D 3/00*** | (2006.01) |

(52) U.S. Cl.
CPC ..... *B24B 41/06* (2013.01); *B25B 1/103* (2013.01); *B25B 9/04* (2013.01); *G10D 3/00* (2013.01)

(58) Field of Classification Search
CPC ..... B25B 1/103; B25B 9/04; B24B 41/06; B23Q 1/34
See application file for complete search history.

(56) References Cited

U.S. PATENT DOCUMENTS

| | | | | |
|---|---|---|---|---|
| 2,882,656 | A * | 4/1959 | Novkov | B25B 1/103 269/258 |
| 3,630,512 | A * | 12/1971 | Paret | B25B 1/2473 269/138 |
| 5,442,844 | A * | 8/1995 | Swann | B23Q 3/103 269/242 |
| 7,101,123 | B1 * | 9/2006 | Weinstein | B23B 47/287 408/103 |
| 2016/0206088 | A1 * | 7/2016 | Illulian | A47B 3/06 |

OTHER PUBLICATIONS

Stewartmacdonald; Nut and Saddle Sander demo by Roberto Fontanot, YouTube.com video; https://www.youtube.com/watch?v=A9LVMtb9jzY&feature=youtu.be; Oct. 2015.*
Nut and Saddle Sander by Heart Sound; https://www.cremonatools.com/nut-and-saddle-sander-by-heart-sound.html, accessed Jun. 5, 2017.*
Saddle Sanding Jig; Dickey Guitars; http://www.dickeyguitars.com/dickeyguitars/Saddlesand.html; accessed Jun. 5, 2017.*
WaybackMachine; Saddle Sanding Jig; http://www.dickeyguitars.com/dickeyguitars/Saddlesand.html; Mar. 2011.*

* cited by examiner

*Primary Examiner* — Daniel J Colilla

(57) ABSTRACT

A handheld precision clamping apparatus for sanding acoustic guitar saddles comprised of a generally rectangular base with a clamping mechanism, comprised of a clamping bar located in the base's lowest extremities, so that the low profile nature of an acoustic guitar saddle can be effectively grasped perpendicular to a separate flat sanding surface, the material to be removed from the saddle extending beyond the flat-bottom surface of the apparatus, ensuring precise material removal.

8 Claims, 6 Drawing Sheets

PRECISION CLAMPING APPARATUS FOR SANDING ACOUSTIC GUITAR SADDLES

BACKGROUND OF INVENTION

1. Field of the Invention

The present invention relates generally to a system for precise sanding and more particularly to a precise sanding method for use on acoustic guitar saddles by individuals or guitar luthiers.

2. Description of the Related Art

Acoustic guitars are very popular with many musicians and individuals playing in bands, solo engagements or just for fun. In some applications, a guitar saddle must be sanded down to interface with an under-saddle pickup or to lower the strings' action for easy playing of the instrument or for changing out an existing saddle for a better material such as bone, tusk, etc. It is very important that the bottom surface of the guitar saddle is perpendicular to its sides and perfectly flat, which is critical to proper pick up function and sound. The applicant realized the need to accomplish this in a precise way.

The applicant looked for such an apparatus that would fulfill his needs. After searching the internet and trade magazines for luthier tools, no adequate apparatus was available. The most common method for removing material from the saddle is to make a pencil mark or scribe line on the saddle and remove material using a belt sander, disk sander, vise and file, or while holding the saddle in your hand moving it back and forth on a piece of sandpaper taped down to a flat surface while trying to keep the sides of the saddle at 90 degrees and maintaining equal pressure on both ends of the saddle. Ensuring accurate positioning of the saddle while sanding is very difficult, and the results only approximate. A milling machine would be very accurate, but job setup would take some time, and a milling machine can be very expensive while offering little other use to guitar makers. As a result, the applicant invented this precision clamping apparatus.

This invention will make precision guitar saddle work easy and efficient, in addition to providing a clamping method for holding the saddle secure while sanding to a precise amount. This method, which uses feeler gauges, makes this a very precision tool for saddle work.

For example, aftermarket electrical sound pickups are installed under the existing saddle and rest on the guitar body where the saddle was originally. Because the pickup has a finite thickness, in some cases 0.053", one would need to remove 0.053" from the bottom of the saddle to maintain the guitar's playing characteristics, or action. Using the aforementioned methods is a very time consuming task, and, with the exception of using a milling machine, holding these tolerances is near impossible. The risk of removing too little or too much material from the saddle is very probable, and the end result is having to start over with a new saddle, creating additional costs and loss of time for the individual or repair shop.

BRIEF SUMMARY OF THE INVENTION

In one embodiment of the present invention, the precision clamping apparatus, employing a clamping bar for holding the saddle in place during sanding, includes an aluminum base with an L-shaped slot for both accepting the saddle and holding the clamping bar; a clamping bar held in place by a roll pin on either end; two clamping bar screws to hold the saddle during sanding; a set of replaceable stainless steel shoes which simultaneously provide superior durability as a sanding surface and also secure the clamping bar in its slot; and a push pin for seating the saddle to an underlying flat surface.

BRIEF DESCRIPTION OF THE SEVERAL VIEWS OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appended drawings. It is to be noted, however, that the appended drawings only illustrate preferred embodiments of this invention, and are therefore not to be considered limiting of its scope, for the invention may admit to other equally effective embodiments that vary only in detail. In the drawings.

DETAILED DESCRIPTION OF THE INVENTION

The preferred embodiment of the precision clamping apparatus 10 of the present invention will now be described with reference to FIGS. 1-6.

Figure 1:
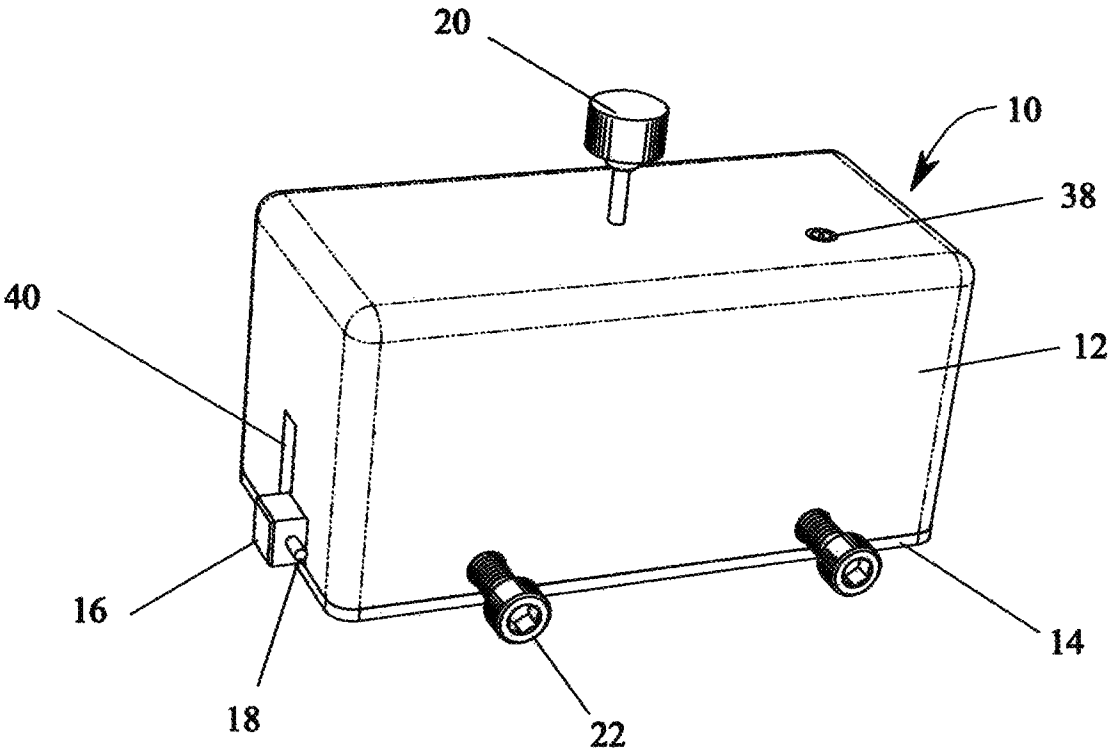
FIG. 1 is a front side perspective view of a preferred embodiment of the precision clamping apparatus, showing the base and its components.

Referring to FIG. 1, a preferred embodiment of the precision clamping apparatus 10 is comprised of a base 12; clamping bar 16; roll pins 18 for holding clamping bar in place; internal clamping face 40; shoes 14, which are replaceable after excessive wear; socket cap clamping screws 22, preferably #8-32×¾" 304 stainless steel, for tightening clamping bar 16; and pushpin 20. Preferably, the base 10 is made of aluminum 6061, approximately 1.5"×1.5"×3.25" in size, although other sizes and materials may be utilized. The clamping bar 16 fits in the horizontal leg of the L-shaped slot in base 12, allowing clamping bar 16 to move freely from front to back. Preferably, the clamping bar is made of ¼"×¼"×3.58" stainless steel key stock. A ball plunger 38 secures pushpin 20 in its storage hole when pushpin is not in use.

Figure 2:
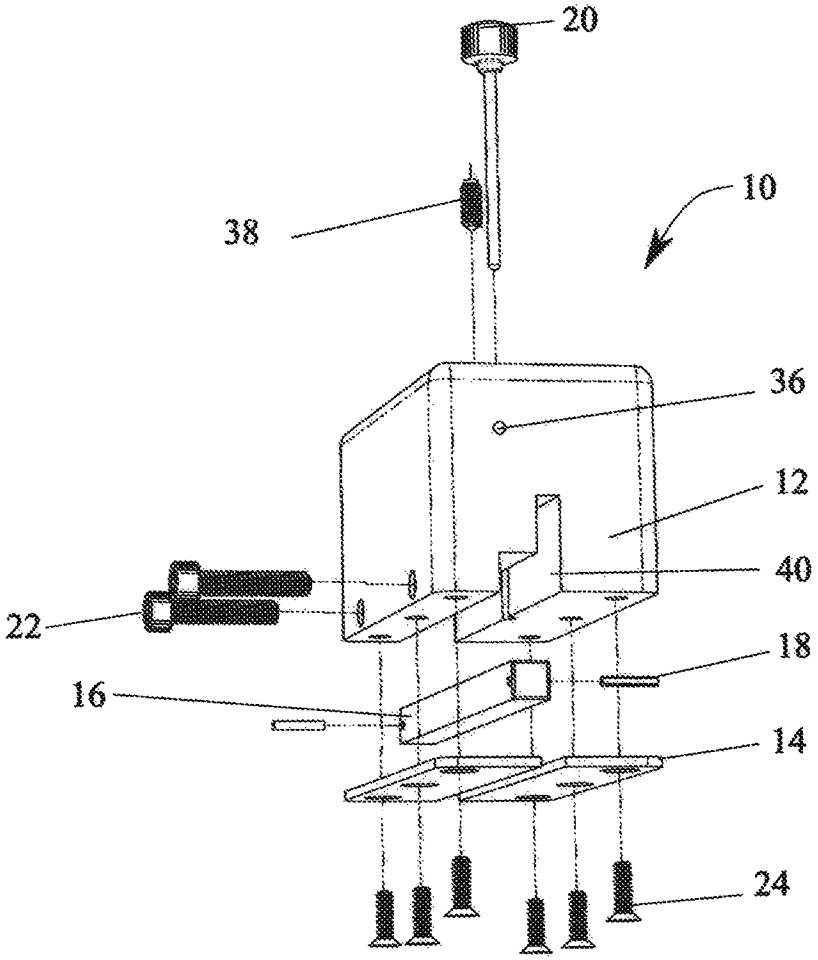
FIG. 2 is an exploded view of the precision clamping apparatus shown in FIG. 1, showing all components.

Referring to FIG. 2, a full view of push pin 20 is shown, preferably measuring 0.062" in diameter and approximately 1.38" in length and with a knurled knob on top. Preferably, the push pin 20 is made of CRES 300 series stainless steel.

Figure 3:
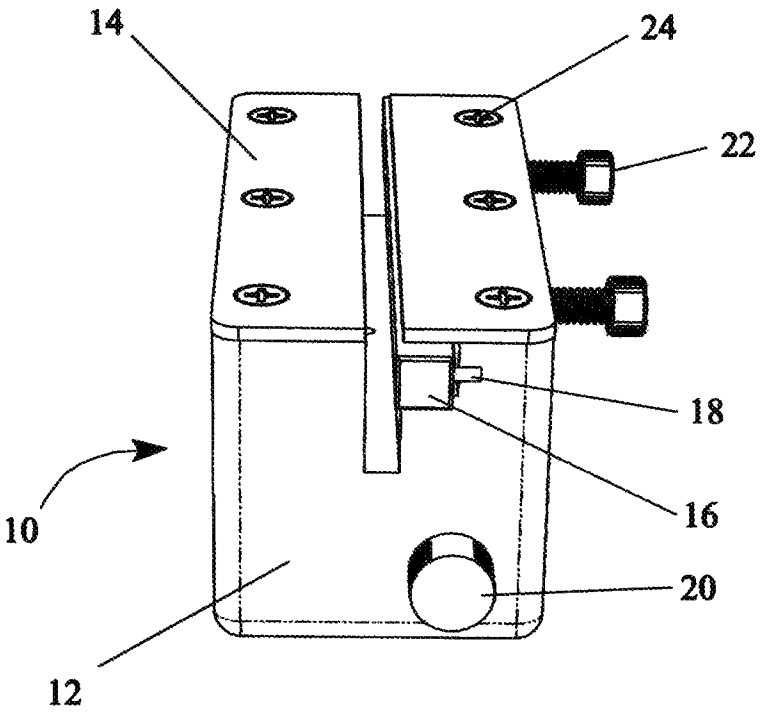
FIG. 3 is a right side perspective view of the precision clamping apparatus shown in FIG. 1, showing the bottom shoes with the clamping bar in the open position and push pin in its storage position.

Referring to FIG. 3, the shoes 14 are preferably 0.672"×3.25"×0.063" in size and made of CRES 300 series half-hard or full-hard stainless steel, although other hard materials may be utilized. The shoes 14 are secured with screws 24, preferably 18-8 stainless steel 100 degree flat head Phillips machine screws, 4-40 thread, ⅜" length. In a preferred embodiment, the right and left side of the clamping bar 16 will be kept in place using two roll pins on either end, preferably 1/16"×½" stainless steel. Also, the bottom side of the clamping bar is held in place by the front side shoe.

Figure 4:
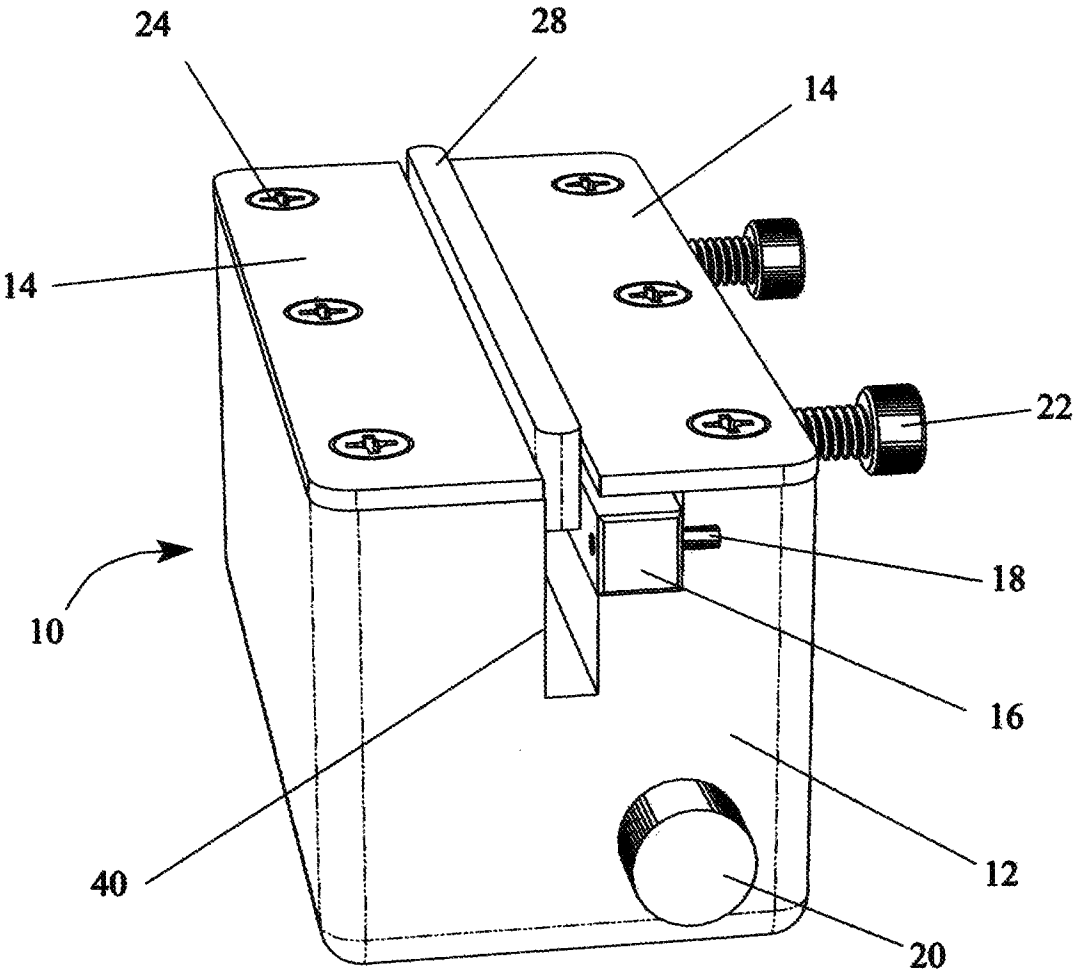
FIG. 4 is a right side perspective view of the precision clamping apparatus shown in FIG. 1, showing the bottom shoes with the clamping bar in the closed position and with a guitar saddle clamped in place.

Referring to FIG. 4, a guitar saddle 28 is shown clamped in the precision clamping apparatus. Push pin 20 is shown in its storage position.

Figure 5:
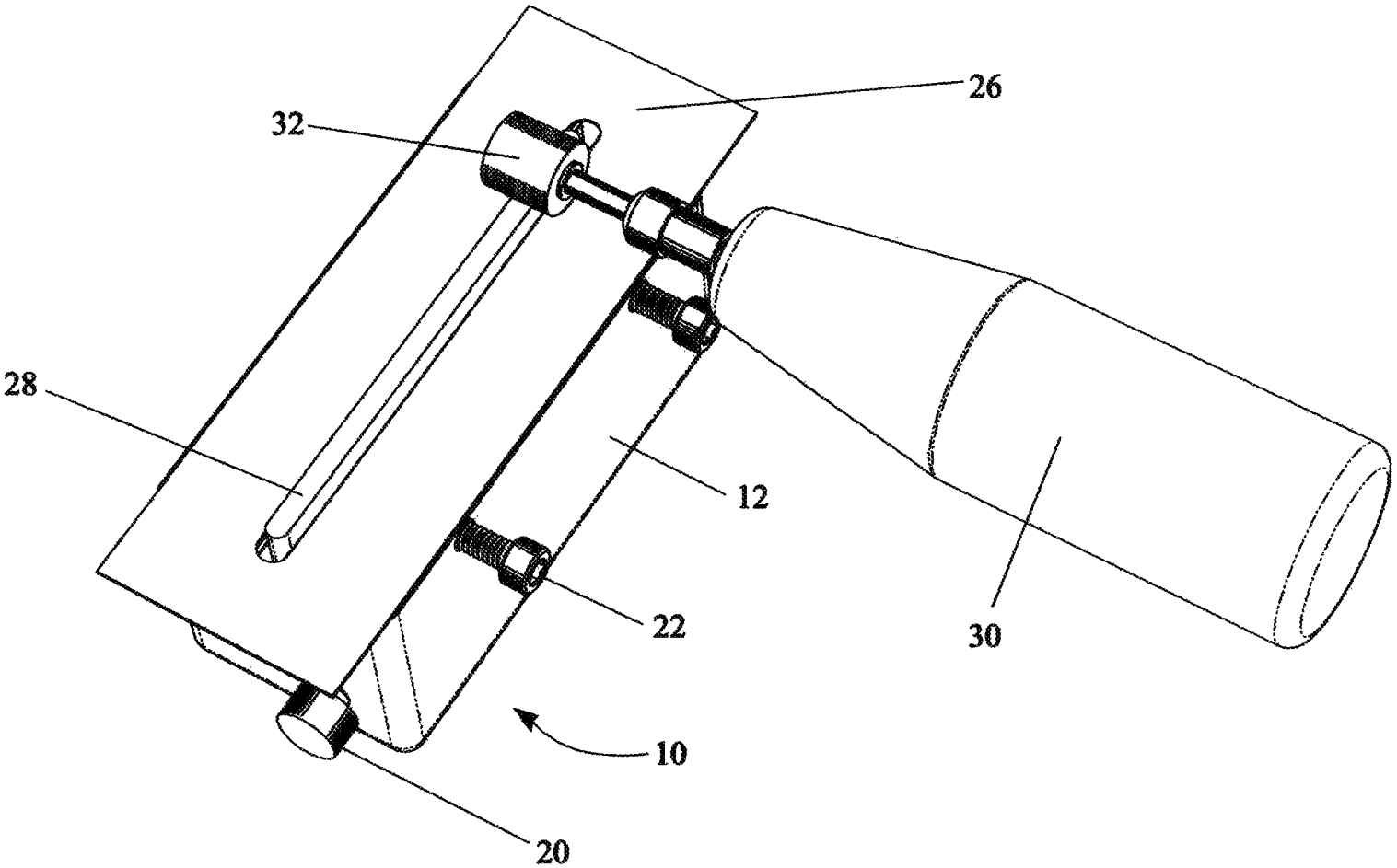
FIG. 5 is a bottom perspective view of the precision clamping apparatus shown in FIG. 1, showing a protective plate for rough sanding with an electric rotary tool using sanding drum attachment, before the final precision sanding procedure previously described.

Referring to FIG. 5, shoe guard 26 is shown, preferably CRES 300 series stainless steel 0.018" thickness, along with hand-held electric rotary tool 30 and sanding drum attachment 32.

Figure 6:
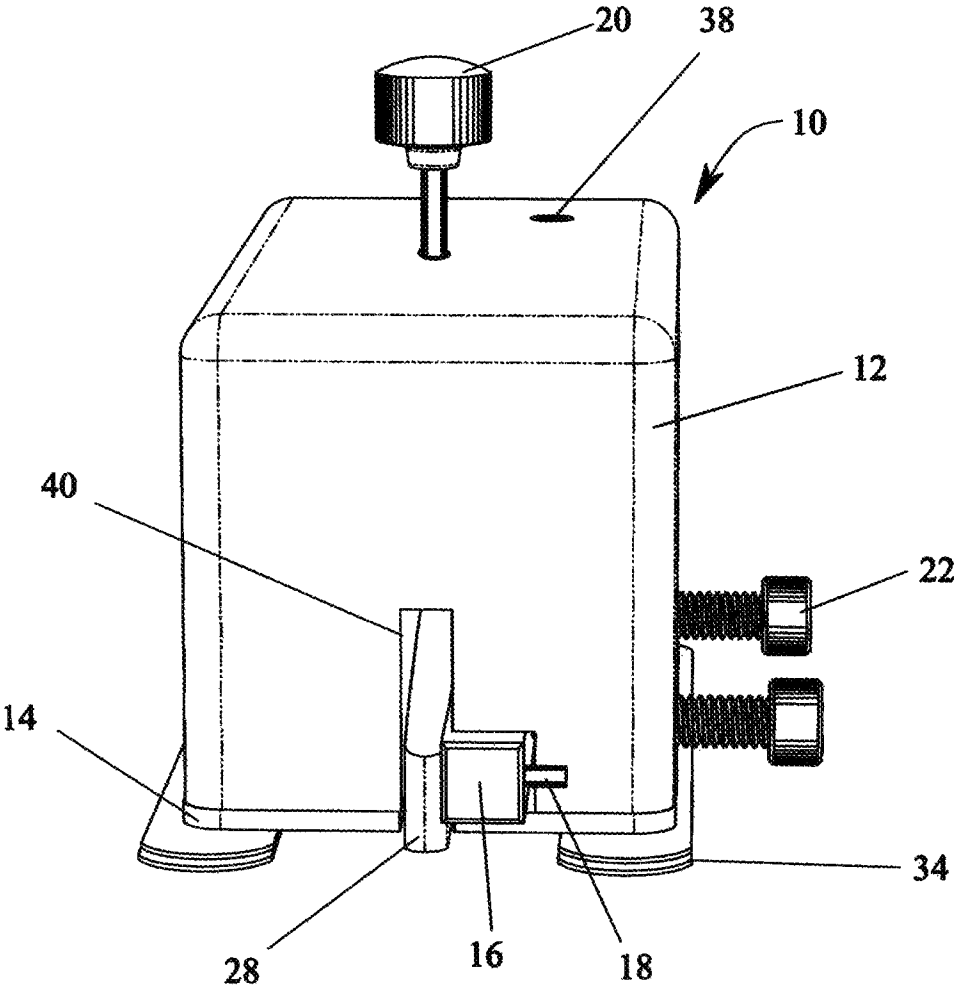
FIG. 6 is a left-side perspective view of the precision clamping apparatus shown in FIG. 1, resting upon feeler gauges with guitar saddle installed and prepared for final sanding procedure.

As shown in FIG. 6, a preferred embodiment of the precision clamping apparatus 10 is shown resting upon two equivalent stacks of feeler gauges 34 in order to set the amount of saddle material to be removed equal to the height of the feeler gauge stacks.

The sum of these parts that make up the preferred embodiments of the precision clamping apparatus function in unison with the feeler gauges and flat sanding surface.

The following is representative of the process employed when using the precision clamping apparatus 10 according to a preferred embodiment:

1. After determining the amount needed to be removed from guitar saddle 28, create two stacks of feeler gauges 34 of equivalent height as shown in FIG. 6. When installing a Fishman Matrix Pickup, for example, to maintain current action on a guitar, remove 0.053" from the bottom of the saddle per manufacturer's instructions by making two stacks of feeler gauges 0.053" each as shown in FIG. 6, set on a flat surface, preferably a 12"×12" granite plate.
2. To insert saddle as shown in FIG. 4, turn base 12 so that clamping screws 22 face downward in order to prevent saddle from dropping below clamping bar. Slide saddle into slot so that bottom of saddle is flush with shoes and finger-tighten clamping screws.
3. As shown in FIG. 6, set precision clamping apparatus 10 on feeler gauge stacks 34, each stack 0.053" in height, so that the shoes 14 rest upon the feeler gauges.
4. Loosen socket cap screws 22 so that saddle drops onto flat surface, preferably a 12"×12" granite plate. While holding the precision clamping apparatus 10 firmly down on feeler gauge stacks, use index finger to push down on push pin 20 to seat saddle down on flat plate.
5. Use appropriate hex wrench to re-tighten socket cap screws 22 firmly so that only that portion of material to be removed from saddle 28, in this case 0.053", extends beyond shoes 14 as shown in FIG. 6. Pushpin 20 can now be stored as shown in FIGS. 3-5 in storage hole 36 as shown in FIG. 2.
6. Referring to FIG. 5, if removing more than 0.018", first remove the bulk of the material off the bottom of the saddle 28 using the optional shoe guard plate 26 and electric rotary tool 30 with drum sander attachment 32. Otherwise, proceed to the next step.
7. The saddle is now ready for the final sanding procedure. Tape a sheet of sandpaper to a flat surface (preferably a 9"×11" sheet of 150 grit silicon carbide affixed to a 12"×12" granite plate as was used to support the feeler gauge stacks 34). Holding the precision clamping apparatus 10 in your hand, sand the bottom of the saddle until no more material can be removed. You are now finished. For example, if you are installing a Fishman Matrix pick up, you will have uniformly removed precisely 0.053" from the bottom of the saddle.

The total process takes about 5 minutes.

When using the precision clamping apparatus 10, the individual or guitar luthier will be able to take precise amounts off the bottom of a guitar saddle while avoiding mistakes and eliminating the need for extraordinary skills. In some applications, such as crafting one's own saddle, a pencil line or scribed line may be preferred and the feeler gauges will be unnecessary. For this method, the saddle can be installed in the precision clamping apparatus 10 finger-tight, and the mark on the saddle can be lined up with the bottom of the back shoe 14.

The foregoing disclosure and description of the invention are illustrative and explanatory thereof, and various changes in the size, shape and materials, as well as in the details of the illustrated construction, may be made without departing from the spirit of the invention. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A clamping system for precision sanding comprising:

a clamping apparatus comprising:

a base including an L-shaped slot with a clamping bar located therein, the clamp being used to press a workpiece at least partially located in the L-shaped slot to an internal surface of the base;

a set of feeler gauges for defining the amount of material to be removed from a workpiece by stacking one or more feeler gauges of the set of feeler gauges under the clamping apparatus;

a pushpin positionable in a channel passing from the top of the base to the L-shaped slot, whereby the pushpin allows a user to press the workpiece against a flat surface, whereby a workpiece can be set into the clamping apparatus with a precise amount of the workpiece to be removed extending out of the L-shaped slot.

2. The system of claim 1 comprising:

at least one clamping screw for applying a force to the clamping bar, wherein the clamping bar comprises a shape suitable to contact the shape of the workpiece to be modified.

3. The system of claim 1 wherein a. the clamping bar translates to contact a workpiece to apply clamping forces;

b. the base further comprises at least one pin for preventing said bar from becoming removed from said base, c. a portion of the L-shaped slot in said base retains and guides said clamping bar as it translates, and d. a screw or screws push against said clamping bar, so that, when rotated, cause said clamping bar to move against the workpiece.

4. The system of claim 1 wherein the set of feeler gauges define an amount of material to be removed from the workpiece by contacting a face of one of the feeler gauges of the set of feeler gauges with a surface of said base that contacts a surface meant to abrade the workpiece, and placing one or more feeder gauges of the set of feeler gauges between said surface of said base and an external flat reference surface thereby defining a gap into which the workpiece is inserted to create a defined amount of material removal.

5. The system of claim 4 wherein the surface of the base comprises a replaceable shoe fixed to the base, the shoe contacting a surface of the abrading device when removing material of the workpiece.

6. The system of claim 1 further comprising a storage hole for storing said pushpin when the pushpin is not in use.

7. The system of claim 1 wherein the clamping apparatus is hand held for precision sanding a workpiece.

8. A method for sanding an object comprising:

clamping a workpiece to be sanded into an L-shaped slot of a base of a clamping apparatus;

placing the clamping apparatus with the workpiece located therein on one or more reference plates supported on a flat surface to set or change an amount of material to be removed from the workpiece;

pressing a pushpin through the base to press the workpiece against the flat surface thereby seating the workpiece against the flat surface;

releasably restraining the workpiece to the base in a manner that immobilizes it and preserves its relative position and adjustment; and removing material by creating contact, or relative motion, or both between the workpiece and a separate abrading device, in one or more setups or configurations, until the abrading device is prevented from removing further material by contacting a bottom surface of said base, whereby a workpiece can be accurately modified in a simplified process.

* * * * *